US005993110A

United States Patent [19]

Bueno

[11] Patent Number: 5,993,110

[45] Date of Patent: Nov. 30, 1999

[54] BALLAST SYSTEM FOR COMPACTING MACHINES

[75] Inventor: Alfredo Aurélio de Antunes Bueno, Sao Paolo, Brazil

[73] Assignee: Svedala Dynapac LTDA, Sorocaba, Brazil

[21] Appl. No.: 08/952,688

[22] PCT Filed: Oct. 26, 1995

[86] PCT No.: PCT/BR95/00048

§ 371 Date: Jan. 23, 1998

§ 102(e) Date: Jan. 23, 1998

[87] PCT Pub. No.: WO96/38631

PCT Pub. Date: Dec. 5, 1996

[30] Foreign Application Priority Data

May 31, 1995 [BR] Brazil ..... 9502171

[51] Int. Cl.[6] ..... G01K 19/26

[52] U.S. Cl. ..... 404/130; 404/122

[58] Field of Search ..... 404/130, 72, 122

[56] References Cited

FOREIGN PATENT DOCUMENTS 2133535 12/1971 France ..... 404/130

*Primary Examiner*—Thomas B. Will
*Assistant Examiner*—Raymond W Addie
*Attorney, Agent, or Firm*—Abelman, Frayne & Schwab

[57] ABSTRACT

A ballast system is provided for a compacting machine, which operate on their own weight (static weight) and is propelled on rollers or wheels. A plurality of identical, modular, ballast boxes are mounted to the median extension of the machine which is located between the front and rear wheel axel assemblies. In order to facilitate adjustment of a static compacting load to ideal operating conditions; each ballast box can receive a variable amount of a flowable material.

8 Claims, 4 Drawing Sheets

BALLAST SYSTEM FOR COMPACTING MACHINES

FIELD OF THE INVENTION

The present invention relates to a ballast system for compacting machines and, more particularly, to a modular ballast system to be used in compacting machines, which operate by their own weight and move on rollers or wheels.

BACKGROUND OF THE INVENTION

The compacting machines operating by their own weight (static weight) have their weight increased by the addition of water, sand or scrap in spaces defined inside the compacting cylinders or rollers, or also inside the chassis, which is constructed in order to define a reservoir in the space existing between the front and rear wheel-axle assemblies.

These known ballast systems require the handling of bulk materials and do not allow the easy control or adjustment of the mass of the material supplied to the ballast spaces, in order to adapt the weight of the compacting machine to the needs of the operation to be carried out. In these prior art solutions, the ballast control requires the use of a scale, which is hardly ever available in the working yard.

Besides the inconvenience cited above, the density of the bulk material fed into the ballast reservoirs or spaces requires the creation of considerable volumes in the equipment design, so as to accommodate the necessary amount of ballast material.

Another inconvenience of the known technical solutions results from the fact that the difficulties for charging and removing the bulk materials usually avoid the adjustment of the equipment, in terms of ground load, to the ideal conditions of each application and of the material to be compacted.

In the particular case of the wheeled compacting machines, the load per wheel is a determinant factor for obtaining a desired compacting level, because it directly influences the pressure value resulting from the contact of the tire with the material to be compacted.

It should also be observed that the space, which is necessary for providing the usual ballast of humid sand, avoids the achievement of high loads per wheel and therefore limits the compacting capacity of the equipment. In general, the most common wheeled compacting machines provide a load per wheel from about 3,000 Kg to about 3,500 Kg. Nevertheless, it has been more and more frequent the need for compacting applications requiring a load per wheel of about 4,000 Kg, which load has been obtained up to now only through very heavy equipments, which are very costly and with limitations concerning transportation, visibility and maneuverability.

DISCLOSURE OF THE INVENTION

Thus, the object of the present invention is to provide a ballast system for compacting machines, which work by their own weight and move on rollers or wheels, allowing for an extremely easy adjustment of the static compacting load to the ideal conditions of the operation to be carried out, without requiring the provision of large load spaces in the machine design and allowing to obtain high loads per region where the machine contacts the material to be compacted.

It is also an object of the present invention to provide a ballast system for compacting machines, which has the characteristics cited above and which eliminates the feeding and removing operations of the ballast bulk material for obtaining the adjustment of the static compacting load in the equipment.

These and other objectives of the present invention are achieved through a ballast system for compacting machines which work by their own weight and which comprise a chassis supported on front and rear wheel-axle assemblies longitudinally spaced from each other, the chassis median extension comprised between the front and rear wheel-axle assemblies defining a raised platform provided with ballast lateral retaining means, in which there are fitted and locked, against downward vertical and horizontal displacements, respective lateral engaging means of modular ballast elements, which are disposed transversely under the chassis median extension and which have a weight that is selectively determined in function of the characteristics of the compacting load desired for the wheel-axle assemblies.

The above constructive form allows an easy and fast ballast substitution, in order to obtain a precise adjustment of the compacting load to the particularities of the operation to be executed, this adjustment being achieved through predetermined data related to the weights of the different modular ballast elements available and to the positions selected for mounting said ballast elements along the chassis median extension.

BRIEF DESCRIPTION OF THE DRAWINGS

The invention will be described below, with reference to the attached drawings, in which.

BEST MODE FOR CARRYING OUT THE INVENTION

Figure 1:
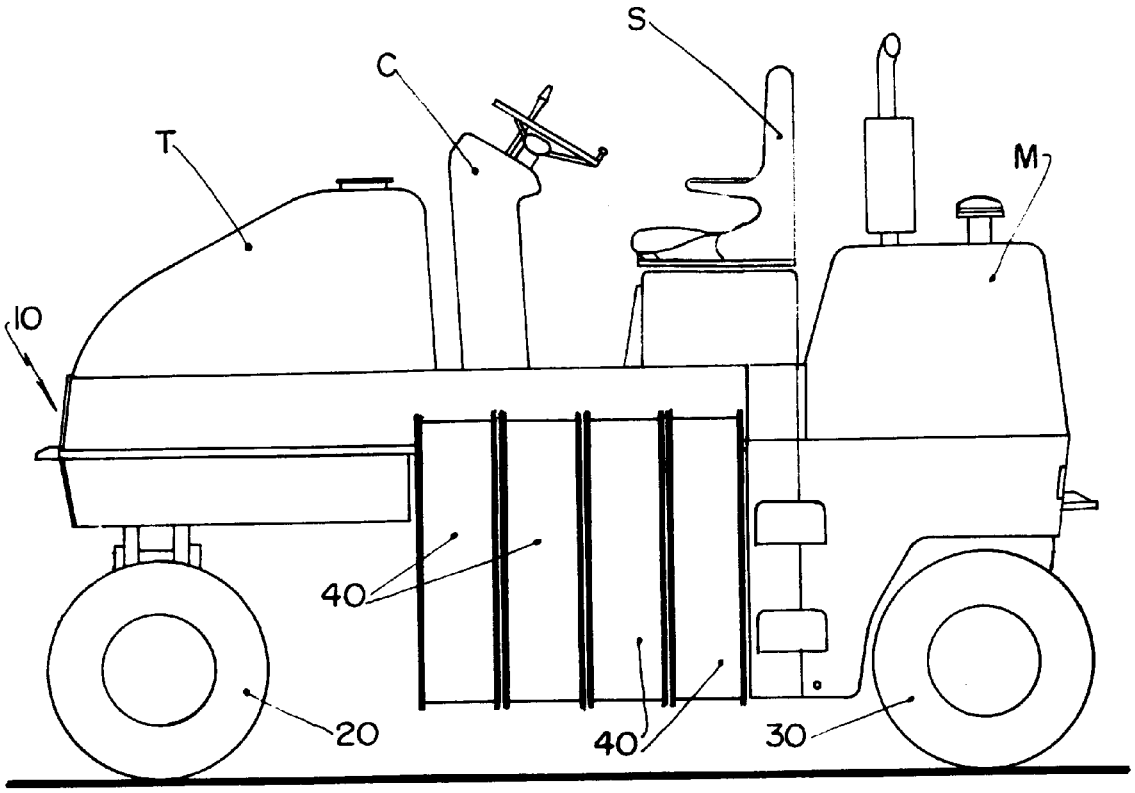
FIG. 1 shows an elevational side view of a wheeled compacting machine provided with the ballast system of the present invention.
Figure 2:
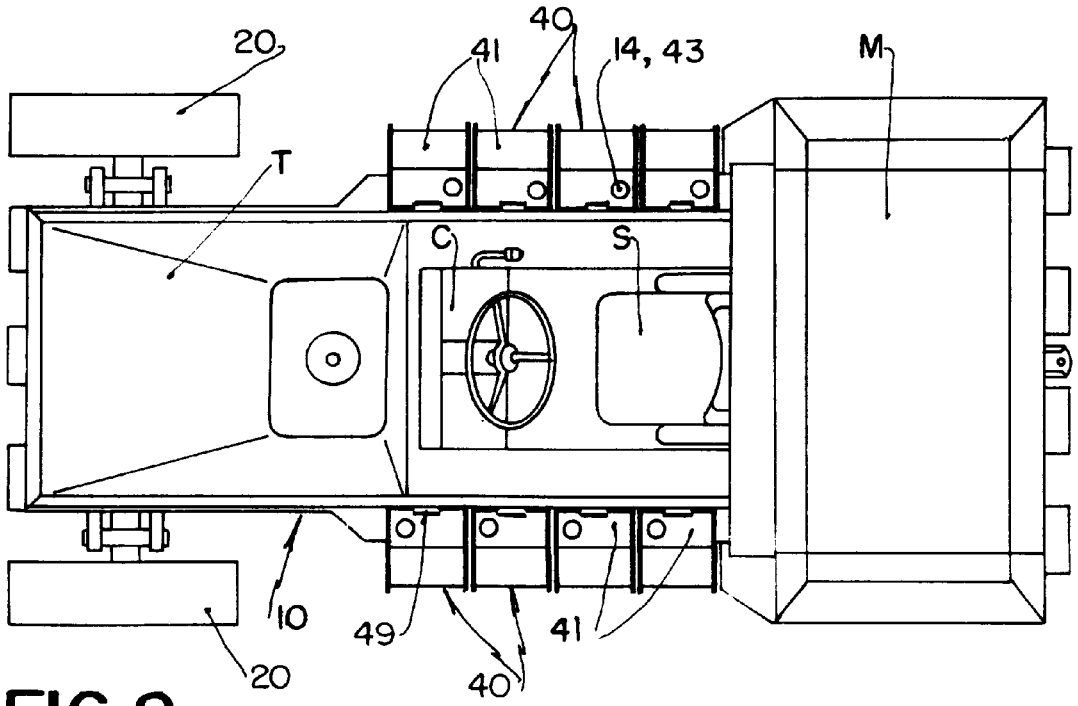
FIG. 2 shows a top plan view of the machine of FIG. 1.
Figure 3:
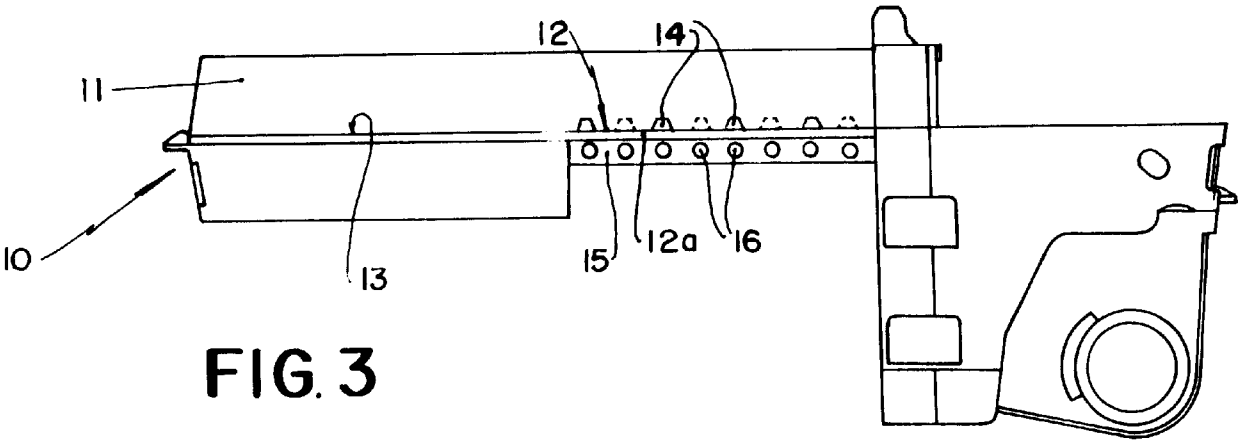
FIGS. 3 and 4 show, respectively, an elevational side view and a simplified plan view of the machine of FIGS. 1 and 2, without the wheel-axle assemblies and upper components for a better visualization.
Figure 4:
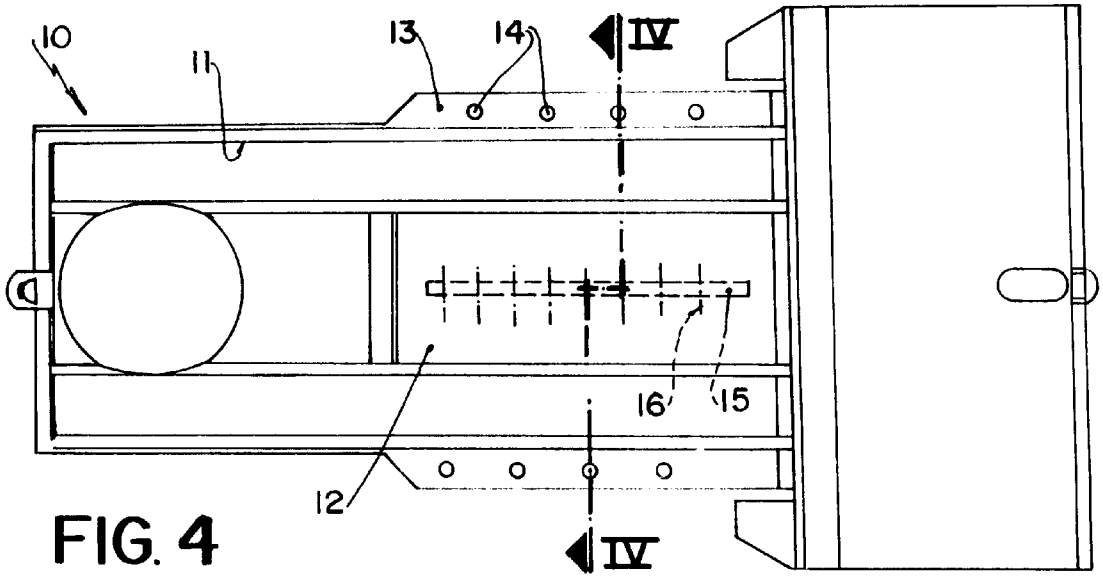
Figure 5:
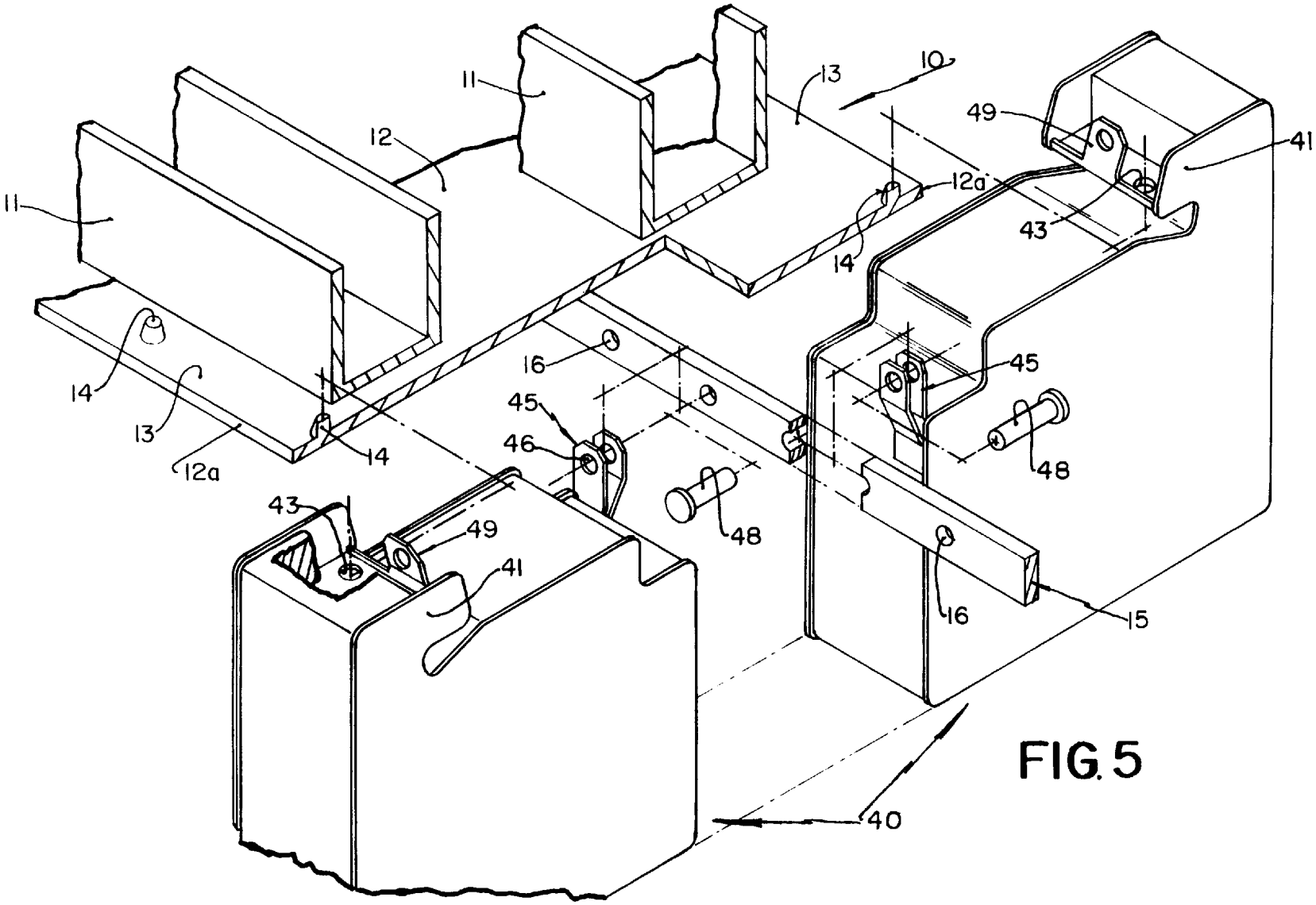
FIG. 5 is an exploded perspective view of a two-piece ballast element, in its mounting position to the chassis median extension and illustrated in a partial view.

According to the illustrations above, the modular ballast system of the present invention is applied to a compacting machine which works by its own weight, comprising a chassis 10, conventionally supported on a front wheel-axle assembly 20 and a rear wheel-axle assembly 30. In the illustrated construction, these wheel-axle assemblies are defined by five tires in the front wheel-axle assembly and four tires in the rear wheel-axle assembly. As mentioned in the beginning of this description, said wheel-axle assemblies may further be defined by steel rollers and/or cylinders of a known construction.

Onto the chassis 10, there are conventionally mounted an engine M, a fuel tank T, a seat S for the operator and a console C containing the control panel and driving wheel.

According to the present invention, the chassis is constructed in order to have, between the front wheel-axle assembly 20 and rear wheel-axle assembly 30, a median extension defining a raised platform.

In the illustrated construction, this chassis median extension is formed by two metallic struts 11, under which there is affixed a horizontal plate 12, whose lateral edges 12*a* project outwardly from said struts 11, in order to define on each side of the chassis 10 a supporting table 13.

Each supporting table 13 incorporates upper portions, defining a plurality of frusto-conical projections 14 which are longitudinally aligned and spaced from each other by a predetermined distance, as evidenced ahead. The projections 14 from one of the supporting tables 13 are arranged symmetrically with the projections 14 of the other supporting table 13 and relatively to the longitudinal axis of the machine, each projection 14 defining a ballast lateral retaining means, which operates together with a corresponding projection 14 of the other supporting table 13, in order to allow the mounting of a respective ballast element transversely disposed under the chassis median extension.

In the illustrated embodiment, each ballast element takes the form of a pair of ballast boxes 40, which are substantially identical, parallepipedal and transversely symmetrically aligned in relation to the machine longitudinal axis, each ballast box 40 having an external end portion provided with an upper engaging shoulder 41, which is substantially horizontal and facing inwardly, and an internal end portion provided with an upper fork 45, projecting over the upper face of the ballast box and provided with a through bore 46 disposed according to the transversal alignment of the machine longitudinal axis, said fork 45 being offset towards one of the sides of the ballast box 40.

Figure 6:
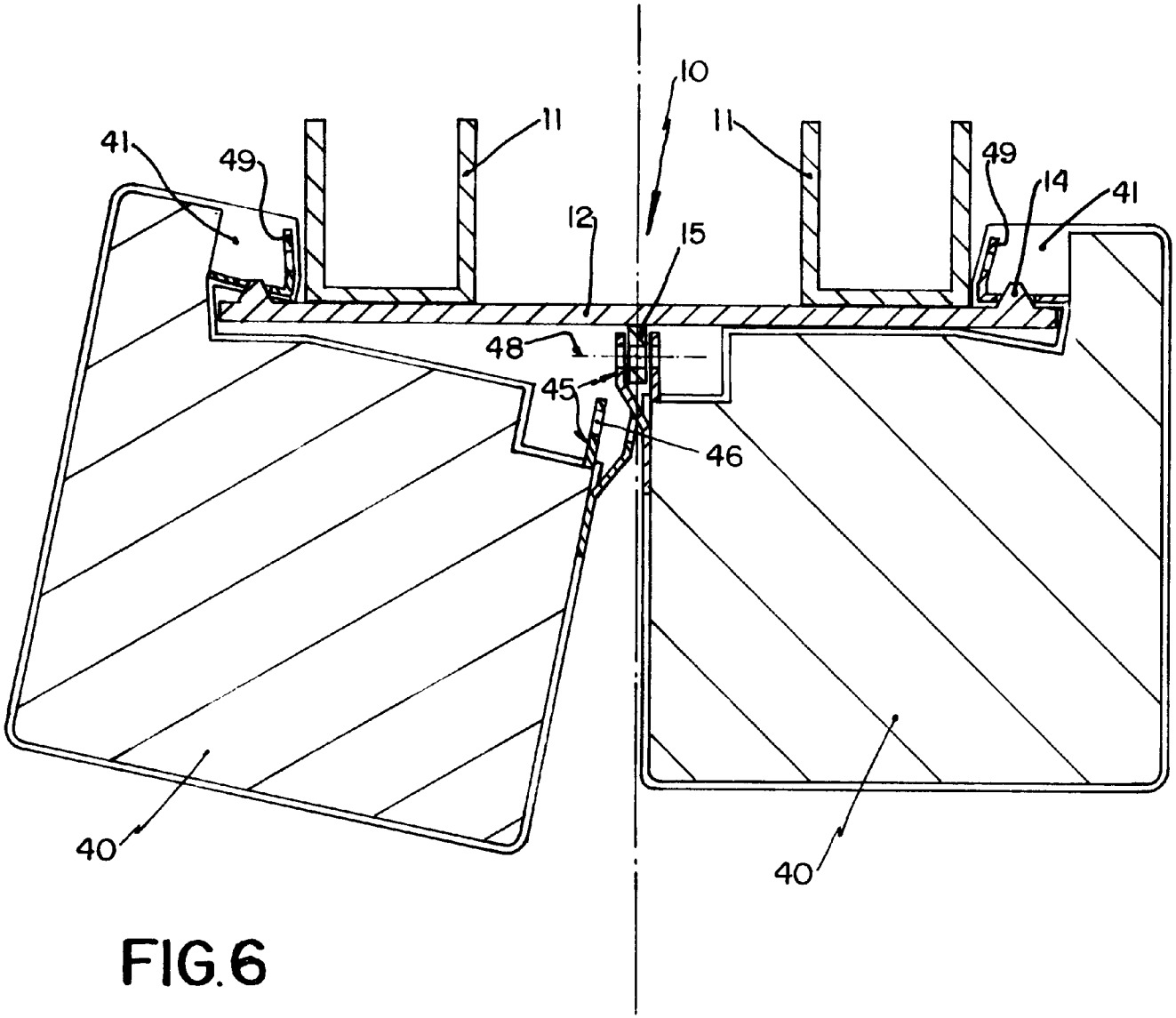
FIG. 6 is a vertical cross view of the machine, taken along line VI—VI of FIG. 4, showing half of the ballast element already mounted under the chassis and the other half being mounted.

The engaging shoulder 41 has its bore dimensioned to allow therewithin the fitting of one of the projections 14 of the supporting tables 13 of the chassis 10 when a ballast box 40 is mounted to said chassis, as illustrated in FIG. 6. As it can be observed, the shoulder 41 defines a lateral engaging means for providing the seating and retention, against downward vertical and horizontal movements, of the external end portion of the ballast box 40 onto the respective supporting table 13 of the chassis 10.

Although each ballast element is defined by a pair of ballast boxes 40, it should be understood that these two boxes may consist of one single body, transversely disposed under the chassis median extension and having its two opposite lateral engaging means defined by the engaging shoulders 41, coupled to the ballast lateral retaining means supported by the supporting tables 13, according to the illustrated embodiment.

It should also be understood that the ballast lateral retaining means of the chassis, as well as the lateral engaging means of the ballast elements may be constructed in different manners, provided that they allow for the firm retention of the external end portions of the ballast elements to the chassis 10.

Back to the illustrated embodiment, the upper fork 45 is designed so as to be fittable onto a central longitudinal bar 15, affixed under the plate 12 of the chassis 10 and provided with a plurality of through bores 16 along its extension, said bores 16 being positioned so as to be aligned with the bore 16 of the fork 45 of a ballast box 40, when the latter has the bore 43 of the engaging shoulder 41 fitted into a projection 14 of a respective supporting table 13 of the chassis 10. After engaging fork 45 with the bar 15, the aligned bores of both parts receive a lock pin 48 of adequate construction, as in the form of a bol-tnut assembly, for providing the locking of the internal end portion of the ballast box under the chassis 10.

As observed in FIG. 6, when a ballast box 40 has its lateral and central engaging means coupled to chassis 10, the upper face of ballast box 10 remains closely adjacent to the lower face of plate 12 of chassis 10, imparting rigidity to the box-chassis assembly and preventing the box from disengaging from the respective projection 14. Thus, fork 45 defines a central engaging means for providing the attachment of the internal end portion of each ballast box 40 to a central retaining means of the chassis 10 defined by the bar 15 in the illustrated embodiment.

As regards the construction described herein, the eccentricity of fork 45 is necessary to avoid the alignment of the forks of each pair of ballast box 40 upon the mounting of said fork to the longitudinal central bar 15. Although the bores 43 of the engaging shoulders 41 may be centrally arranged relative to the respective ballast boxes, they are also preferably displaced toward one of the sides of the box, so as to be aligned with the bores 46 of the respective forks 45. Thus, in the illustrated embodiment, each bore 16 of the longitudinal central bar 15 is contained in a plane transversal to the machine longitudinal axis and containing a respective ballast lateral retaining means provided at one side of the chassis 10.

The ballast boxes 40 are constructed with adequate dimensions for obtaining a number of possible weight combinations which are necessary to the possible variations of the working conditions to be achieved by the machine.

Moreover, the ballast boxes should have a height which permits to use the free space of the machine available under the median extension of the chassis 10, between the front wheel-axle assembly 20 and the rear wheel-axle assembly 30. Since the ballast boxes are preferably modular and have the same standard dimensions, the adjacent projections 14 of each supporting table 13 are spaced from each other by a distance only slightly superior to the width of the ballast boxes 40, allowing that these boxes, when mounted, be seated laterally against the immediately and longitudinally adjacent ballast boxes 40, giving more stability to the ballast assembly during the machine operation.

The ballast boxes 40 may also be provided with a suspension shoulder 49 incorporated to the upper shoulder 41, in order to facilitate their movimentation and even their mounting to the chassis when said mounting is carried out by an auxiliar load lifting equipment.

As illustrated in FIG. 6, the mounting of each ballast box 40 is carried out, by seating its engaging shoulder 41 onto a projection 14 of one of the supporting tables 13, while maintaining the ballast box 40 slightly downwardly inclined, so that the fork 45 may be positioned under the central longitudinal bar 15. After this initial positioning (see left half of FIG. 8), the ballast box 40 has its internal end portion raised, until the through bore 46 of fork 45 is aligned with a respective through bore 16 of the central longitudinal bar 15, when the lock pin 48 is positioned through said bores, locking the ballast box 40 in the operational position illustrated in the right half of FIG. 6.

As it can be observed, the ballast system presented herein allows the disposition of an assembly comprising modular ballast elements of different weights and which are fast and easily coupled in a predetermined position to the chassis of the machine, in order to obtain a desired compacting load in the wheel-axle assemblies.

I claim:

1. A ballast system for compacting machines which work by their own weight and which comprise a chassis (10) supported on front and rear wheel-axle assemblies (20,30) longitudinally spaced from each other, characterized in that a chassis median extension, located between the front and rear wheel-axle assemblies (20,30), defines a raised platform (12) provided with a ballast lateral retaining means (14), in which a plurality of modular ballast elements (40) there are fitted and locked against downward vertical and horizontal displacements by respective lateral engaging means (41) of modular ballast elements (40), which are disposed transversely under the chassis median extension and which have a weight that is selectively determined in function of the characteristics of a compacting load desired for the wheel-axle assemblies, each of said modular ballast elements (40) comprising a pair of identical ballast boxes, which are symmetrical to the machine longitudinal axis each of said ballast boxes having an internal end portion provided with a central engaging means (45) coupled to a ballast central retaining means (15) affixed under the chassis median extension.

2. The system, as in claim 1, characterized in that the ballast lateral retaining means (14) are disposed in pairs, the ballast lateral retaining means (14) of each of said pairs being symmetrically disposed and laterally displaced to the opposite sides of the machine longitudinal axis.

3. The system, as in claim 1, characterized in that the chassis median extension has opposite lateral edges **(12*a*), along which the ballast lateral retaining means (14)** are provided.

4. The system, as in claim 2, characterized in that each lateral edge **(12*a*) of the chassis median extension defines a supporting table (13), each of said ballast lateral retaining means (14) being defined by an upper portion of the respective supporting table (13), onto which there is seated said lateral engaging means (41) respective to each of said modular ballast elements (40)**.

5. The system, as in claim 4, characterized in that each ballast lateral retaining means (14) comprises a plurality of upper frusto-conical projections, incorporated to the respective supporting table (13), each lateral engaging means (41) being defined by an engaging shoulder which is substantially horizontal and incorporated to an external end portion of each of said modular ballast element (40) and which is fitted to a respective frusto-conical upper projection (14) upon mounting of the respective side of each of said modular ballast elements (40) to the chassis (10).

6. The system, as in claim 5, characterized in that the ballast lateral retaining means (14) are longitudinally spaced one from the other by a distance slightly superior to the dimension of the ballast elements (14) in the direction of the machine longitudinal axis.

7. The system, as in claim 1, characterized in that the central engaging means (45) of each of said ballast boxes (40) comprises an upper fork, which is upwardly projected at an eccentric point of the internal end portion of the ballast box and which is provided with a transversal through bore (46), said ballast central retaining means (15) being defined by a central longitudinal bar provided with through bores (16), which will be aligned with the through bores (46) of the forks (45) when these latter are fitted onto the central longitudinal bar, each fork (45) being locked to said central longitudinal bar (15) through a lock pin (48) mounted into said through bores of both the fork and longitudinal central bar.

8. The system, as in claim 1, characterized in that, when mounted to the machine, each of said ballast boxes (40) has the upward movement of its external end portion limited by the upper face of the ballast box (40) being seated against the median extension of the chassis (10).

* * * * *